US010889993B2

(12) United States Patent
Bianchi

(10) Patent No.: US 10,889,993 B2
(45) Date of Patent: Jan. 12, 2021

(54) RETRACTABLE STAIRCASE

(71) Applicant: Zev Bianchi, Ourimbah (AU)

(72) Inventor: Zev Bianchi, Ourimbah (AU)

( * ) Notice: Subject to any disclaimer, the term of this patent is extended or adjusted under 35 U.S.C. 154(b) by 307 days.

(21) Appl. No.: 15/751,652

(22) PCT Filed: Aug. 10, 2016

(86) PCT No.: PCT/AU2016/050724
§ 371 (c)(1),
(2) Date: Feb. 9, 2018

(87) PCT Pub. No.: WO2017/024349
PCT Pub. Date: Feb. 16, 2017

(65) Prior Publication Data

US 2020/0199881 A1 Jun. 25, 2020

(30) Foreign Application Priority Data

Aug. 11, 2015 (AU) ..... 2015903242

(51) Int. Cl.
*E04F 11/06* (2006.01)
*E04F 11/02* (2006.01)

(52) U.S. Cl.
CPC ..... *E04F 11/062* (2013.01); *E04F 2011/0209* (2013.01)

(58) Field of Classification Search
CPC ..... E04F 11/062; E04F 2011/0209
See application file for complete search history.

(56) References Cited

U.S. PATENT DOCUMENTS 2,220,155 A * 11/1940 Jachim ..... E06C 9/06 182/1
3,299,590 A * 1/1967 Carter ..... E04F 11/0255 52/183
3,626,438 A * 12/1971 Cornell ..... E04F 11/0255 52/183
3,693,754 A * 9/1972 Butler ..... E04F 11/062 182/86

(Continued)

FOREIGN PATENT DOCUMENTS

DE 682831 C * 10/1939 ..... E04F 11/062
DE 3217334 11/1983

(Continued)

OTHER PUBLICATIONS

International Search Report for PCT/AU2016/050724, Comnpleted by the Australian Patent Office on Oct. 4, 2016, 5 Pages.

*Primary Examiner* — Rodney Mintz
(74) *Attorney, Agent, or Firm* — Brooks Kushman P.C.

(57) ABSTRACT

A retractable staircase having a first side stringer and a second substantially parallel side stringer connected to a plurality of steps. The first side stringer is fixedly attached to a wall and the second side stringer is pivotally movable about the first side stringer between an extended position, where the steps lie substantially horizontally between the stringers, and a retracted position where the steps lie substantially vertically between the stringers. The retractable staircase also includes a collapsible handrail and a gate that are interconnected with the side stringers and the pivoting steps so that when one of them is moved, the other two move substantially simultaneously.

29 Claims, 13 Drawing Sheets

(56) References Cited

U.S. PATENT DOCUMENTS 3,912,298 A * 10/1975 Humphrey ..... B60R 3/02 280/166
4,347,638 A * 9/1982 Weaver ..... B60R 3/02 14/71.1
4,642,953 A * 2/1987 DeGood ..... E04F 11/06 52/183
4,768,617 A * 9/1988 Mason ..... B64F 1/315 182/1
4,959,935 A * 10/1990 Stob ..... E01D 15/24 182/156
4,971,168 A * 11/1990 Stanescu ..... B63B 27/14 182/1
5,189,854 A * 3/1993 Nebel ..... B63B 27/14 182/1
6,527,081 B1 * 3/2003 Tyner ..... E04F 11/1834 182/1
6,923,140 B1 * 8/2005 Cook ..... E01D 15/24 114/362
7,866,443 B2 * 1/2011 Truckner ..... E04F 11/0255 182/228.1
10,640,983 B2 * 5/2020 Honeycutt ..... E04F 11/025
2002/0088669 A1 * 7/2002 Truckner ..... E04F 11/1817 182/228.1
2005/0160688 A1 * 7/2005 Truckner ..... E04G 13/06 52/182
2008/0190049 A1 * 8/2008 Muti ..... E04G 27/00 52/183
2010/0293875 A1 * 11/2010 Preston ..... E04F 11/022 52/183
2011/0162303 A1 * 7/2011 Truckner ..... E04G 13/062 52/183
2015/0252568 A1 * 9/2015 Pivetta ..... E04F 19/00 52/188
2017/0275888 A1 * 9/2017 Honeycutt ..... E04G 27/00

FOREIGN PATENT DOCUMENTS

DE 4306418 9/1994
DE 4416426 11/1995
FR 827211 A * 4/1938 ..... E04F 11/062
FR 2136959 A1 * 12/1972 ..... E04F 11/062
FR 2572443 5/1986
WO 0015926 3/2000

* cited by examiner

RETRACTABLE STAIRCASE

CROSS-REFERENCE TO RELATED APPLICATION

This application is the U.S. national phase of PCT Application No. PCT/AU2016/050724 filed on Aug. 10, 2016, which claims priority to AU Patent Application No. 2015903242 filed on Aug. 11, 2015, the disclosures of which are incorporated in their entirety by reference herein.

FIELD OF THE INVENTION

The present invention relates to a retractable staircase or ladder. In particular, the present invention relates to a retractable staircase that has a modular structure.

BACKGROUND

There is an ever-increasing need for space efficient and compact living concepts. As the world becomes more and more populated, the cost of space in urbanized areas, is continually increasing.

Fixed staircases are very widely used but need to have set a large allocated space when installed and if space is at a premium these are not favourable. In addition, fixed staircases can be quite unsightly and obtrusive if a high budget is not available.

Portable ladders are also a good way to access inaccessible places. Unfortunately, these are generally very utilitarian and, therefore, not very attractive even with the more expensive models. Additionally, these ladders are not the easiest structures to climb and they can be very unstable. Treads are usually round and quite painful for feet in soft shoes or bare feet They are also not fixed to anything so there is the potential for them to slip, fall or be moved from the needed location.

Attic or loft ladders are usually concealed in the ceilings of homes and offices and when needed can be pulled down and unfolded. They are generally unsightly and made from inferior materials to keep costs low and weight down. They can also be very expensive due to mechanisms needed to fold up, such as hydraulics or the like, that are needed for young and elderly to use. Furthermore, ladders having folding mechanisms tend to have insufficient strength to be durable in use.

Any discussion of the background art above or throughout the specification should in no way be considered as an admission that such art is widely known or forms part of common general knowledge in the field.

SUMMARY OF THE INVENTION

It is an object of the present invention to overcome or ameliorate at least one of the disadvantages of the prior art, or to provide a useful alternative.

One embodiment provides a retractable staircase comprising: a first side stringer and a second, substantially parallel, side stringer connected by a plurality of steps, the first side stringer having means to be fixedly attached to a wall and the second side stringer being pivotally movable about the first side stringer between an extended position, where the steps lie substantially horizontally between the stringers, and a retracted position where the steps lie substantially vertically between the stringers.

In an embodiment, the staircase consists of a plurality of modules that can be assembled together at home. In particular, each side stringer consists of a plurality of modular sections to enable selecting the length of the staircase. Each modular section of the side stringers includes a toothed male connector and a female receiving part. Each stringer further comprises a top module and a foot module.

In an embodiment, each step is rectangular and pivotally connected to the first, fixed side stringer at one short end and to the second, movable side stringer at the other short end.

In an embodiment, the staircase further includes a handrail attached to the second, movable side stringer by two or more elongate rail arms. The handrail is movable between an extended position where the rail arms are upright and the handrail is substantially parallel to the movable side stringer, and a collapsed position, where the handrail lies adjacent the movable side stringer. In an embodiment, each rail arm is pivotally connected to the movable side stringer via a fixing plate having two releasable locking positions, one for the upright rail arm position and the other for the collapsed position.

In an embodiment, each rail arm comprises two elongate members pivotally connected to one another at one end and to an associated side stringer at the other end. In an embodiment, the rail arm is supported by a locking arm mechanism.

In an embodiment, the handrail is interconnected with at least one of the pivoting steps and adapted to extend or collapse substantially simultaneously with the staircase being extended or retracted respectively. Extending/retracting of the staircase actuates the handrail to be extended or collapsed respectively, and extending/collapsing of the handrail actuates the staircase to be extended or retracted respectively. In an embodiment, a lever mechanism attaches each rail arm to one of the pivoting steps. The lever mechanism comprises at least one ball joint, a lever and a push rod.

In an embodiment, the staircase further includes a gate. The gate is interconnected with the staircase and adapted to open or close substantially simultaneously with the staircase being extended or retracted respectively. Extending/retracting of the staircase actuates opening/closing of the gate, and opening/closing of the gate actuates the staircase to be extended or retracted respectively. The gate is connected to the highest pivoting step by a gear mechanism and a pivotal rod. More specifically, the gate is rotably attached to a fixed (non-pivoting) step by the pivotal rod that extends through the fixed step. Bevel gear mechanism and a second rotating driver rod connects the pivotal rod and therefore, the gate to the highest folding step at its pivot point to the fixed side stringer.

In an embodiment, each one of the handrail, the side stringers together with the pivoting steps, and the gate are interconnected such that moving one moves the other two substantially simultaneously.

In an embodiment there is provided a retractable staircase comprising: a first side stringer and a second, substantially parallel, side stringer connected by a plurality of pivoting steps, the first side stringer having means to be fixedly attached to a wall and the second side stringer being pivotally movable about the first side stringer between an extended position, where the steps lie substantially horizontally between the stringers, and a retracted position where the steps lie substantially vertically between the stringers. The staircase further includes a handrail attached to the second, movable side stringer by two or more rail arms, the handrail being interconnected with at least one of the pivoting steps and adapted to extend or collapse substantially simultaneously with the staircase being extended or retracted respectively. In addition, the staircase includes a gate, wherein the gate is interconnected with the staircase and adapted to open or close substantially simultaneously with the staircase being extended or retracted respectively.

This invention can be used as a fixed staircase when opened but if need be, can be closed up to the wall to free up space in the lower area and disable access between the separate floors. This invention can be used like a ladder, by opening and closing it when needed. Saving space and storing device without physically removing it.

This invention can also be used like a loft or attic ladder but there is no need to reach up and pull down from the ceiling but simply fold down from the wall to have the staircase fold open and become useable for ascent and descent.

This invention can be sold by any hardware stores in as many modular parts as necessary to create the height or incline required to access areas in the users homes or offices. The staircase can be assembled easily by simply clipping parts together and screwing treads into place.

BRIEF DESCRIPTION OF THE DRAWINGS

Embodiments of the invention will now be described, by way of example only, with reference to the accompanying drawings in which.

DETAILED DESCRIPTION

Figure 1C:
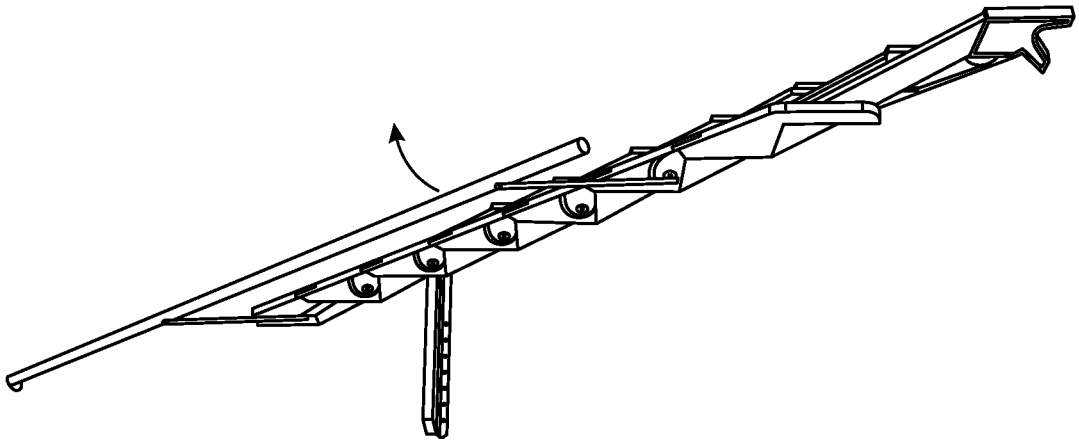
FIGS. 1*a* to 1*e* show the staircase during the motion between the open position in perspective of FIG. 1*a* and the closed position of FIGS. 1*e* and 1*f*, FIG. 1*e* being a side view of the retracted staircase and FIG. 1*f* being the front view of the retracted staircase.
Figure 1B:
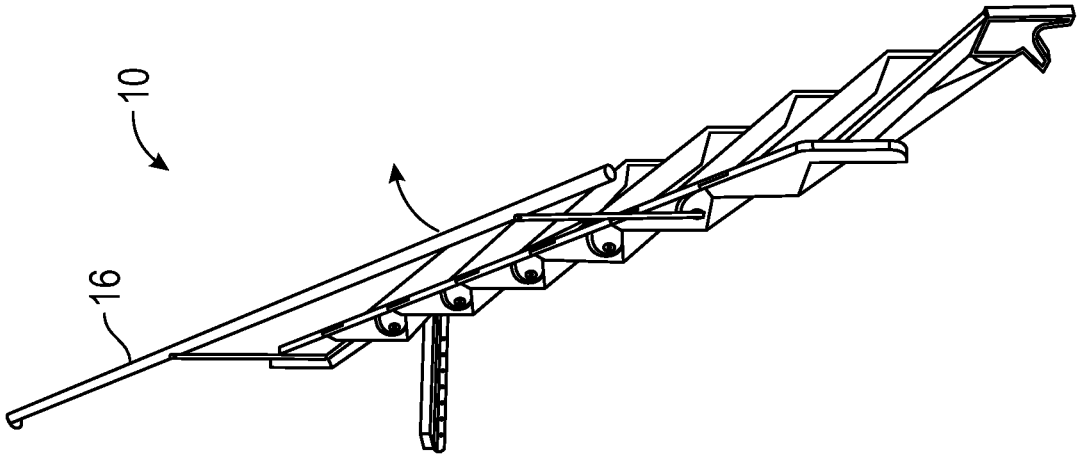
Figure 1A:
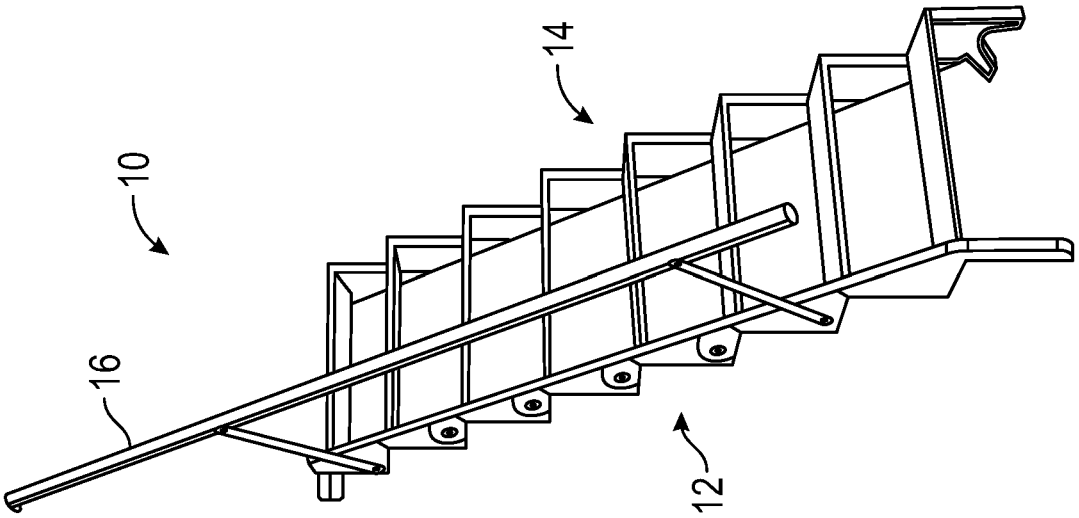
Figure 1F:
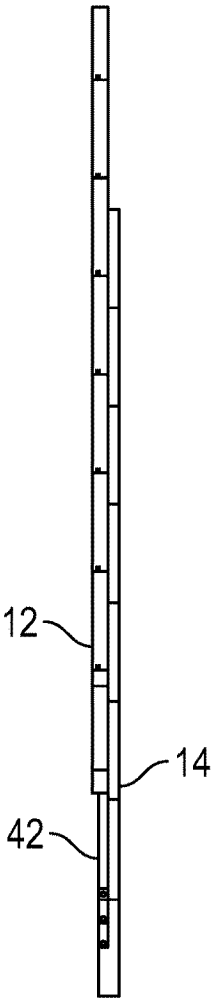
Figure 1E:
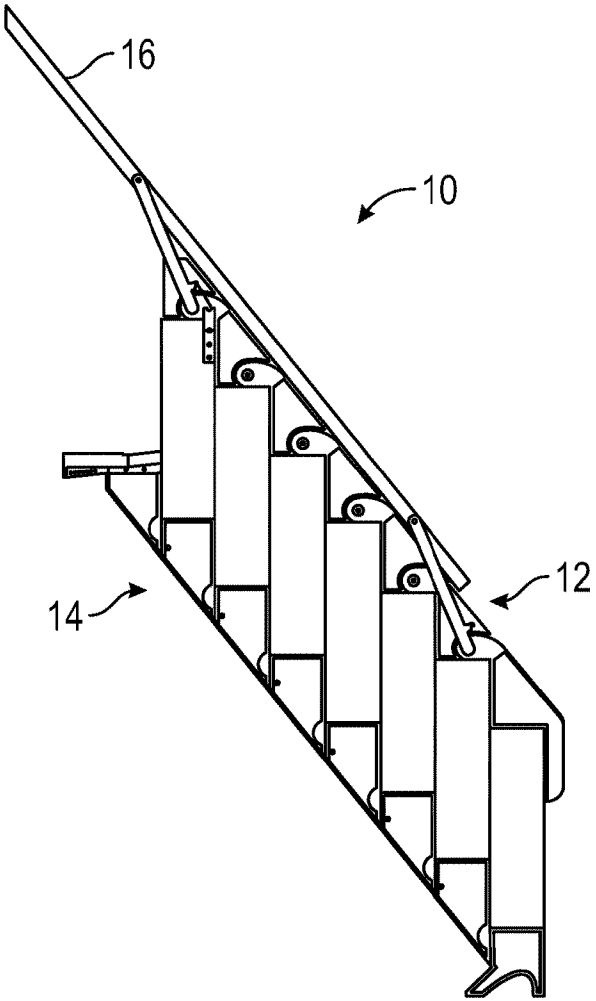
Figure 1D:
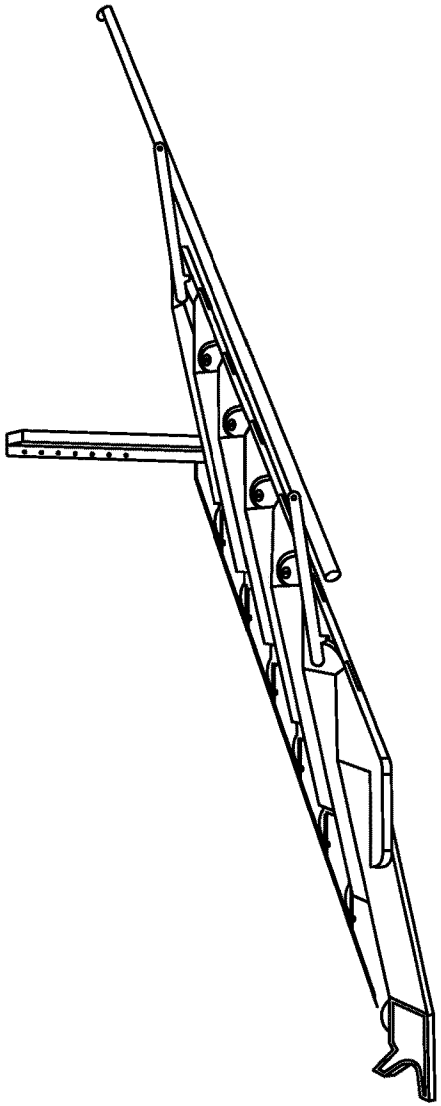

Referring to FIGS. 1*a* to 1*e*, an embodiment provides a retractable staircase that can be folded against a sidewall so that it takes up minimal space in its surroundings. FIGS. 1*a* to 1*e* show a sequential presentation of the closing movement as the staircase is folded from its open, extended position of FIG. 1*a* to its closed, retracted position of FIGS. 1*e* and 1*f*. FIG. 1*e* shows the closed position as a side view and FIG. 1*f* shows the staircase in its closed position from the front, facing the staircase.

This movement enables the stairs to fold up against the wall that the staircase is attached to, achieving maximum space utilization for the area. Alternately, if space is not an issue, this movement can achieve a high level of security by disabling access to alternate levels. Although not seen in FIGS. 1*a*-1*e*, when assembled and installed, the first side stringer 14 of the staircase is fixedly attached to a wall such as a sidewall of a room. The second side stringer 12 moves up and towards the fixed side stringer 14 to the closed, retracted, position of FIGS. 1*e* and *f*. The movement needed is only a slight upward force by the users hand, and the staircase rotates around the fixed side stringer to the folded/retracted position. FIG. 1*f* shows the front view of the staircase 10 folded up. The staircase is substantially flat in a vertical direction. In the retracted position, the movable side stringer 12 lies flat against the wall, separated from the fixed side stringer by the length of each step 42.

Figure 2A:
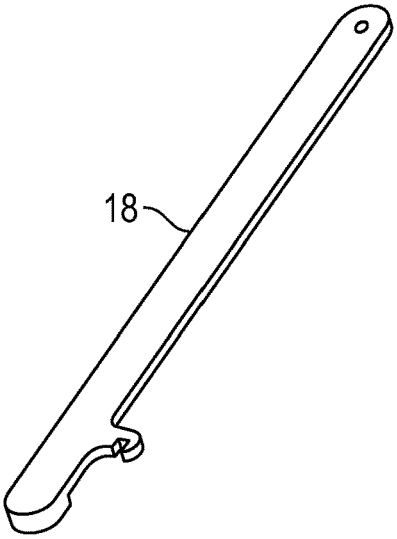
FIGS. 2*a* and 2*b* show a rail arm connecting a handrail to the staircase.
Figure 2B:
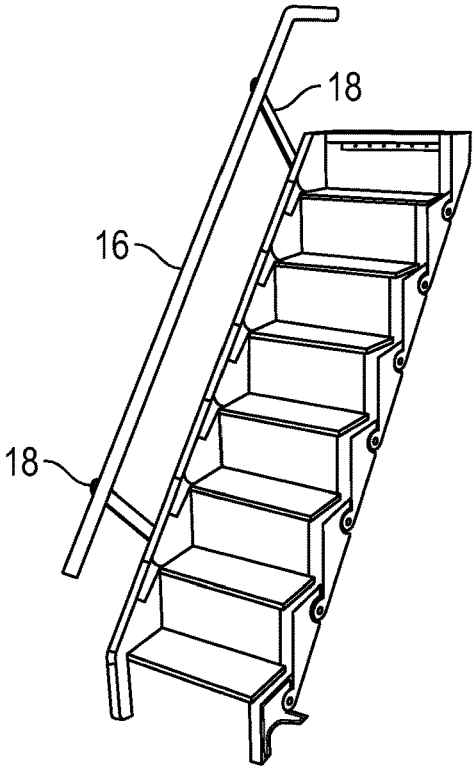
Figure 3A:
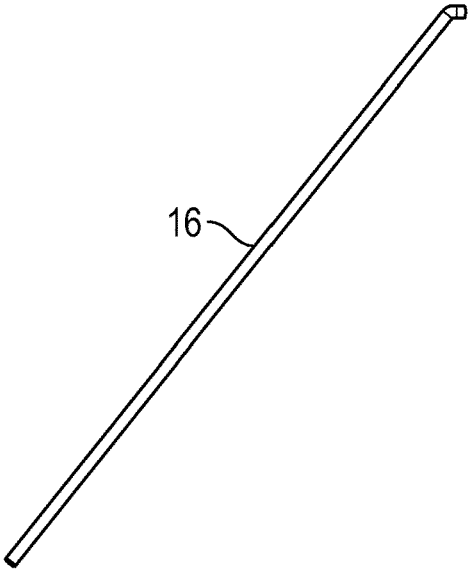
FIGS. 3*a* and 3*b* show a handrail of the staircase.
Figure 3B:
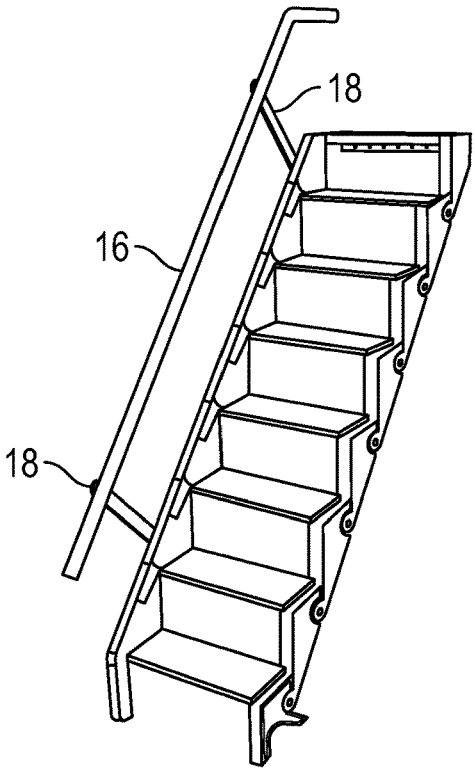

The folding movement is achieved by lifting and pushing the second side stringer 12 of the staircase in a slightly upward motion towards the first side stringer which allows the second side stringer 12 to rotate about the axis of the first, fixed side stringer 14. The handrail 16, seen in FIGS. 1*a*-*e* and in more detail in FIGS. 2 and 3, helps with the opening and closing movement of the stairs by applying mechanical force on the moving side stringer 12. The handrail 16 is adjustable and also adapted to collapse as seen in FIG. 1*e*. Because the height of the staircase is increased when it is folded to the wall, it is an aesthetic feature of the staircase to have the handrail 16 lower itself to minimize the overall size of the structure. It is also ergonomically easy to use the handrail to pull or push the staircase between its extended and retracted positions.

FIGS. 2*a*-2*b* and 3*a*-3*b* show the main parts of the handrail 16. In this embodiment, handrail 16 is a telescopic piece of tubular aluminum that is able to adjust in length so that stairs of different height can be accommodated by one product Handrail 16 attaches to rail arms 18 and provides the extra stability that is required for use of this retractable staircase. Rail arm 18 connects the handrail 16 to the staircase and provides a hinging action that enables the handrail 16 to fold up against the staircase when closed and raise it substantially parallel to the movable side stringer when the staircase is opened. Each rail arm 18 is connected to the movable side stringer via a steel fixing plate (not shown in the accompanying Figures). The fixing plate has two protruding axle studs that allow the rail arm 18 to pivot between these two points and releasably lock into place. Similarly, the handrail 16 is releasably locked into its upright and raised position when the staircase is extended and releasably locks into its retracted position against the movable side stringer when the staircase is retracted. This way, the handrail 16 and the movable side stringer are interconnected so that the handrail automatically extends to the raised position whenever the staircase is moved to the extended position.

Figure 4A:
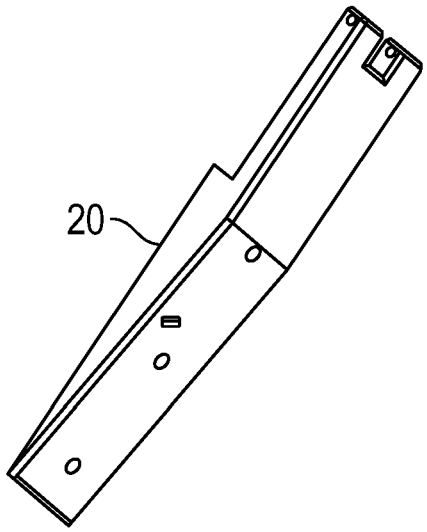
FIGS. 4*a* and 4*b* show a lever and lever mechanism of the handrail.
Figure 4B:
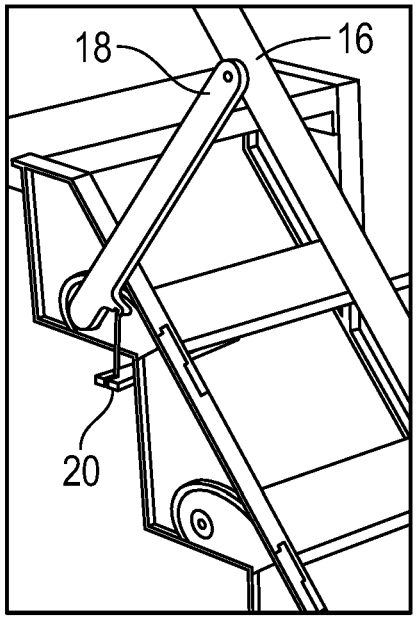
Figure 5A:
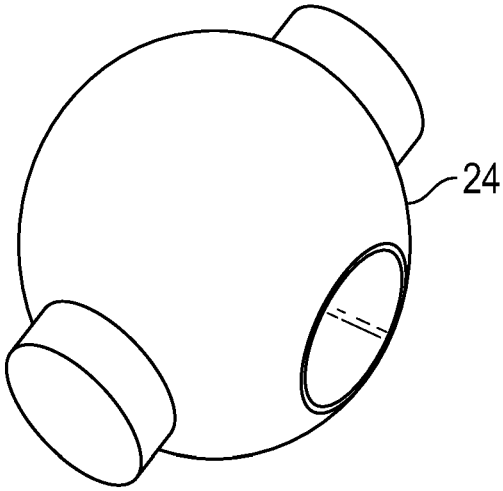
FIGS. 5*a* and 5*b* show a ball joint of the lever mechanism
Figure 5B:
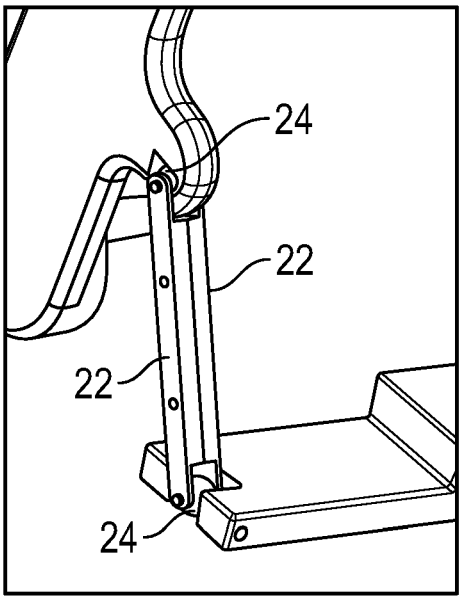
Figure 6A:
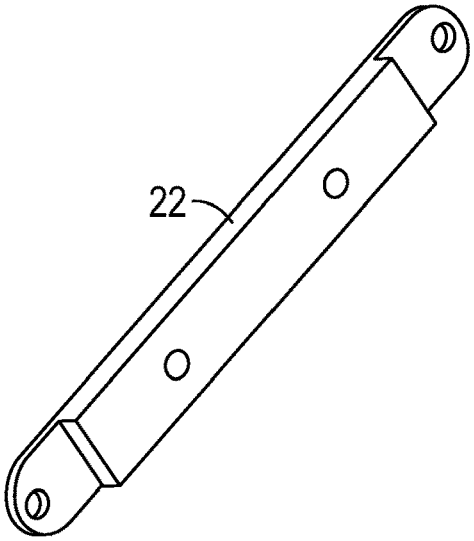
FIG. 6*a* shows a push rod half and FIG. 6*b* shows two push rod halves attached to the lever.
Figure 6B:
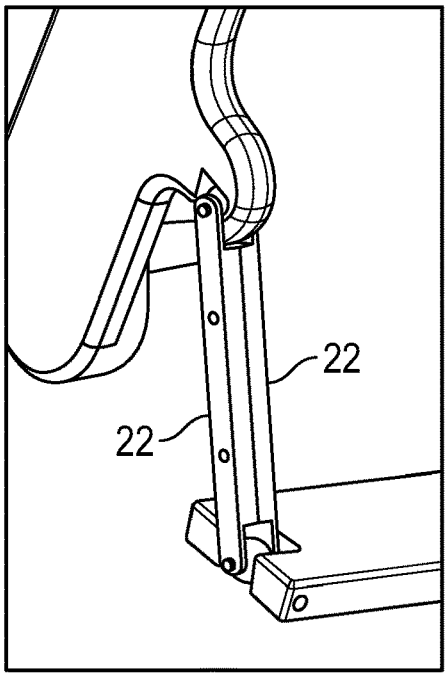
Figure 7A:
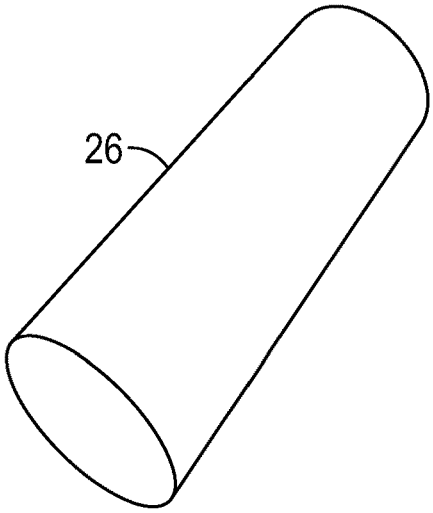
FIGS. 7*a* and 7*b* show a universal joint pin of the lever mechanism.
Figure 7B:
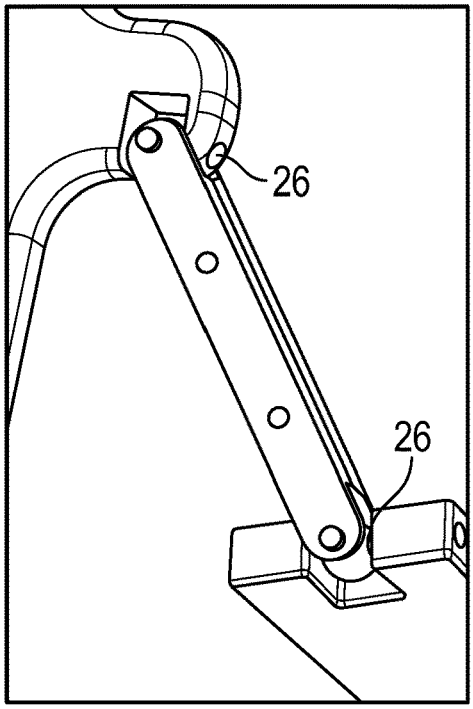

FIGS. 4*a* and 4*b* through to FIGS. 7*a* and 7*b* show a lever mechanism of the handrail 16 in detail. The lever 20 is preferably made of stainless steel although other suitable materials may be used. The lever mechanism attaches to the underside of one or two steps, depending on height of staircase, and to the rail arm. It provides the leverage needed to raise and lower the handrail 16 when opening and closing the staircase. This is achieved through the connection of a universal push rod 22 between the lever 20 and the rail arm 18. The push rod consists of two halves 22 seen in detail in FIGS. 6*a* and 6*b*. The push rod 22 works in conjunction with ball joints 24 at each end of the rod 22, seen in FIGS. 5*a* and 5*b*. The two halves of the push rod 22 are joined together with the two ball joints 24 that are already inserted. Together they create a four-piece unit, excluding screws, that is ready for insertion at the lever 20 and the rail arm 18 by means of the pin entry point.

Figure 8A:
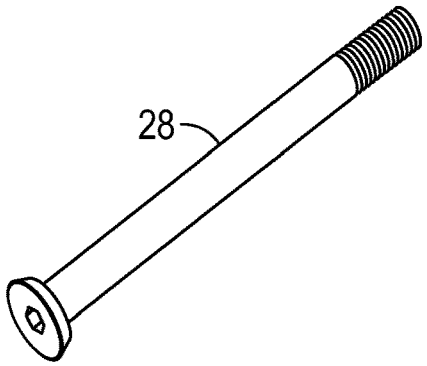
FIGS. 8*a* and 8*b* show a mid-sized screw attaching the rail arm to the handrail.
Figure 8B:
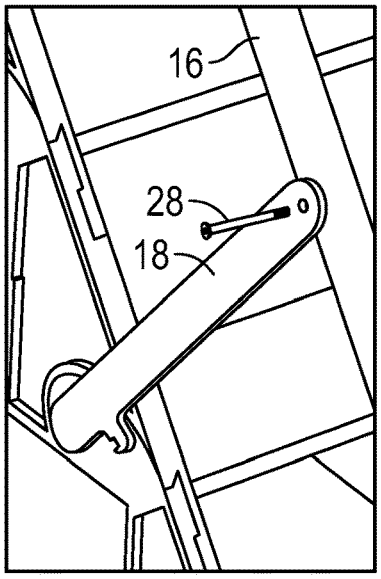

FIGS. 7*a* and 7*b* show universal joint pins 26 that are small pins used to complete the connections in the lever mechanism 20. Socket screws 28, seen in FIGS. 8*a* and 8*b*, are mid-sized screws that attach the handrail 16 to each rail arm 18, with a threaded section.

Figure 20A:
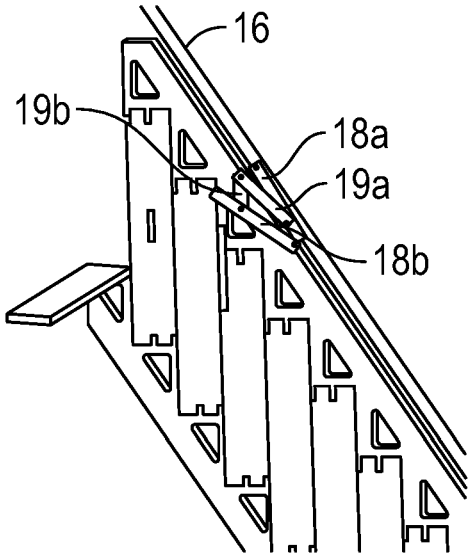
FIGS. 20*a*, 20*b*, 20*c* and 20*d* show movement of a folding handrail between the retracted position of FIG. 20*a* and extended position of FIG. 20*d*.
Figure 20B:
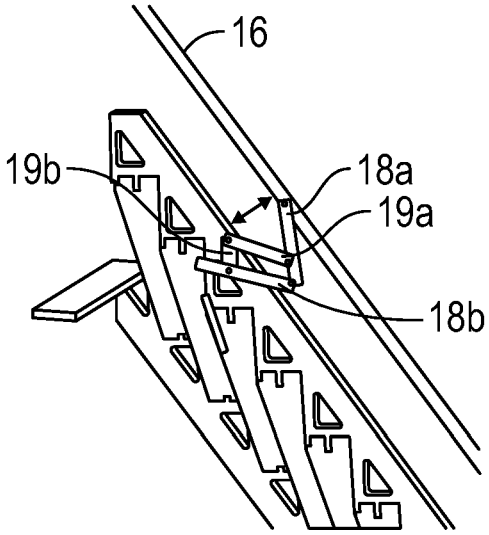
Figure 20C:
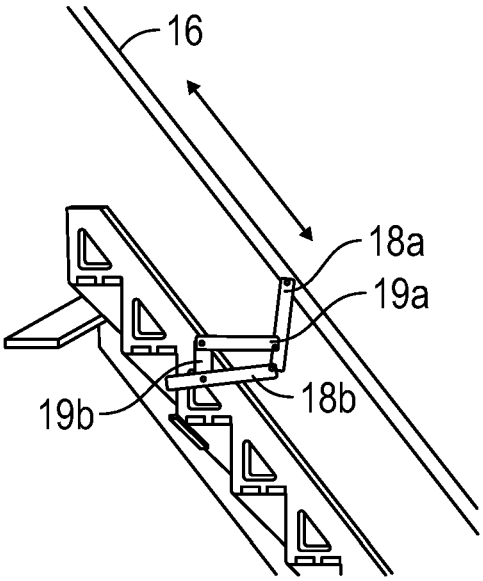
Figure 20D:
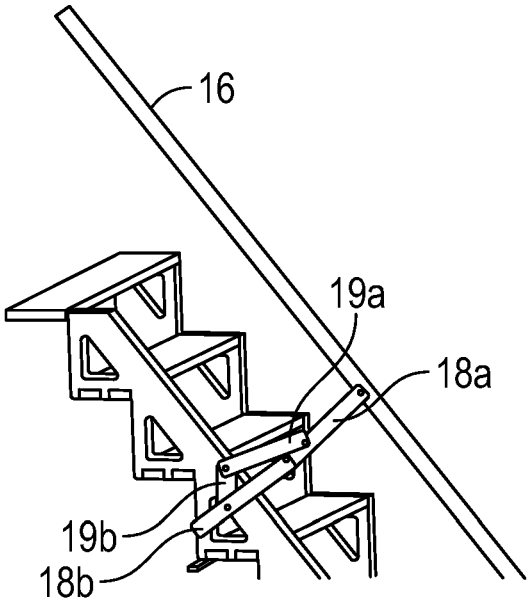

FIGS. 20*a* to 20*d* show another embodiment of the handrail 16. FIG. 20*a* shows a folding handrail in its collapsed position and FIG. 20*d* shows the handrail in its extended position. In this embodiment, the arms of the handrail each are a bi-folding mechanism having a first folding portion 18*a* and a second folding portion 18*b* that are pivotally connected to one another. As the handrail is raised from the retracted position of FIG. 20*a* the two folding portions 18*a* and 18*b* start a pivoting movement to straighten the arm as seen in FIGS. 20*b* and 20*c*. The straightening and the pivoting movement of the portions 18*a* and 18*b* are enabled and supported by the lever arm 19*b* and a locking arm mechanism 19*a*. The locking arm mechanism relieves the pressure on the ball joint connectors 24 when force is applied to the rail in use. When the handrail is in its extended position seen in FIG. 20*d*, the arm portions collide extending into a single extended handrail arm, and lock in place by the locking arm mechanism and the lever arm.

In the embodiment of FIGS. 1 to 3, where the handrail is supported by two or more rail arms 18, the rail arms 18, the lever 20 and the push rods 22 work in conjunction with the ball joints 24 such that whenever the handrail is extended or collapsed, the stairs extend and retract respectively. Similarly, in the embodiment of FIGS. 20*a* to 20*d*, the rail arms 18*a* and 18*b*, the lever arm 19*b* and the locking arm 19*a* work in conjuction with the lever 20, the push rods 22, and the ball joints 24 such that whenever the handrail is extended or collapsed, the stairs extend and retract respectively.

Figure 9A:
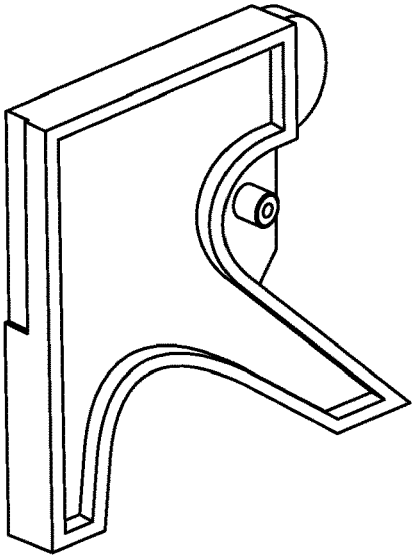
FIG. 9*a* shows a modular base piece and FIG. 9*b* shows the base piece of the fixed side stringer supporting the staircase on the ground.
Figure 9B:
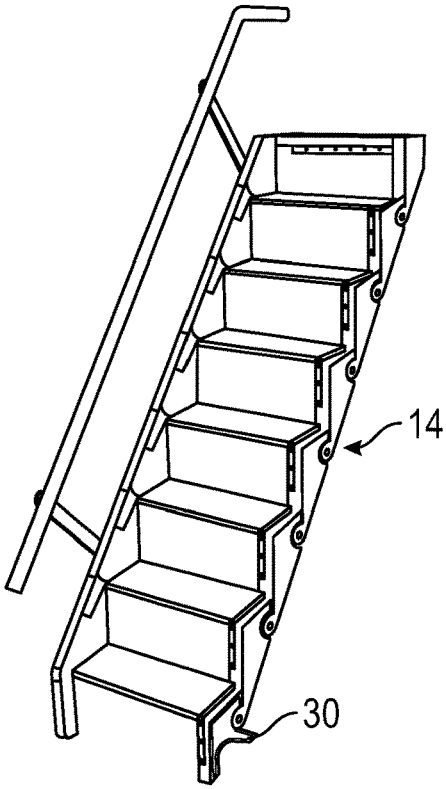
Figure 10A:
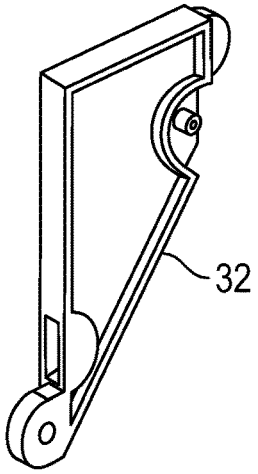
FIGS. 10*a* and 10*b* show an enlarged view of a modular main support piece and a plurality of modular main support pieces on the fixed side of the staircase.
Figure 10B:
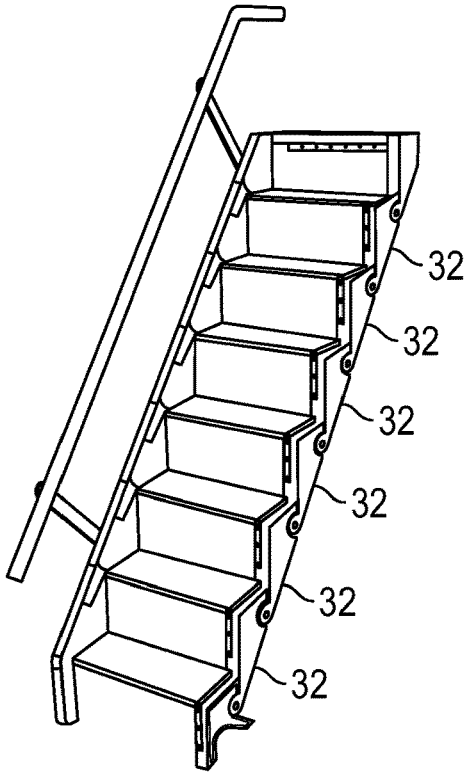
Figure 11A:
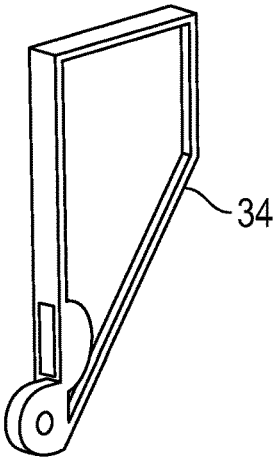
FIGS. 11*a* and 11*b* show a modular top main support piece.
Figure 11B:
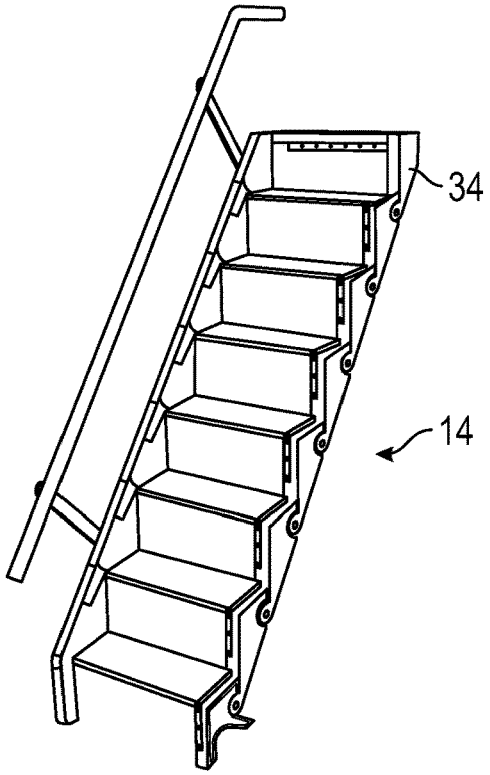

The modular steps are described below with details of the modules shown in FIGS. 9*a* and 9*b* to 19*a* and 19*b*. FIGS. 9*a* and 9*b* show a base (foot) piece 30 of the fixed side stringer 14 of the staircase. The base piece 30 contacts with the ground and supports the rest of the fixed side frame 14. In connection with the base piece 30 is a plurality of modular main support pieces 32 seen in detail in FIGS. 10*a* and 10*b*. The plurality of modular main support pieces 32 forms the adjustable section of the fixed side stringer 14 of the staircase. By adding or subtracting these pieces 32, the height and length of the staircase can be adjusted to any desirable length. The same adjustment in the number of modular pieces must be made on the movable side stringer 12 as well. FIGS. 11*a* and 11*b* show a top support module 34 of the fixed side stringer 14. This module creates the top section of the of the fixed side stringer 14, and provides contact with the wall and the top step or platform for the structure.

Figure 12A:
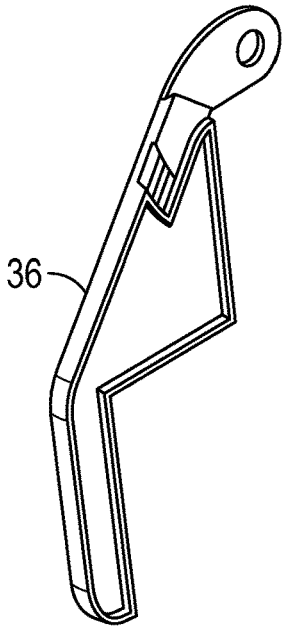
FIGS. 12*a* and 12*b* show a modular moving side foot.
Figure 12B:
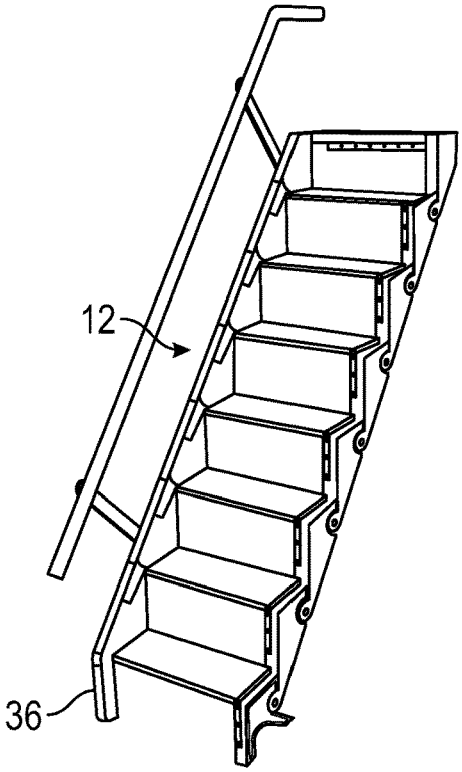
Figure 13A:
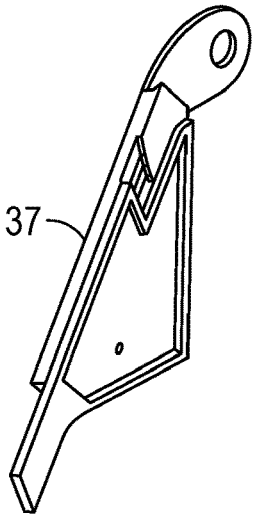
FIGS. 13*a* and 13*b* show a side module of the moving side, and a plurality of side modules on the moving side.
Figure 13B:
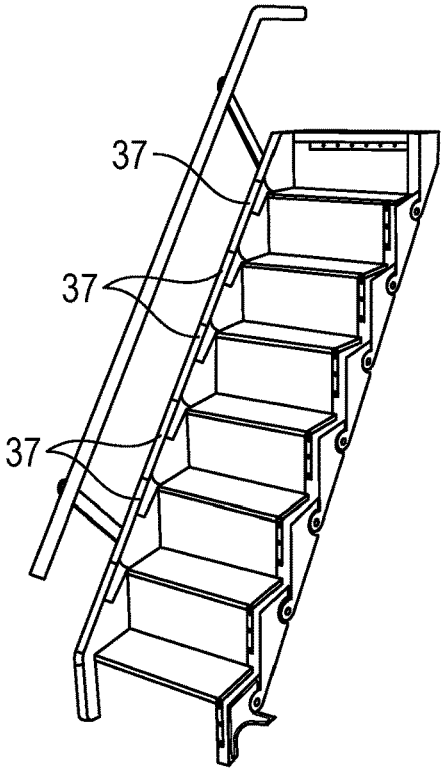
Figure 14A:
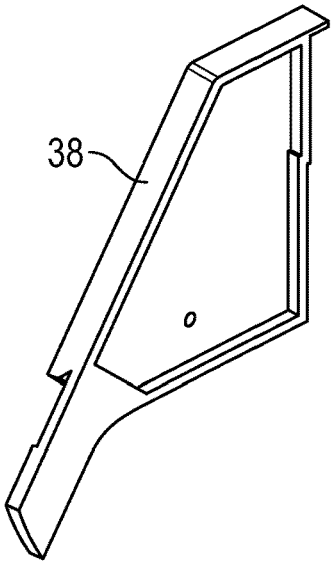
FIGS. 14*a* and 14*b* show a modular moving side top piece.
Figure 14B:
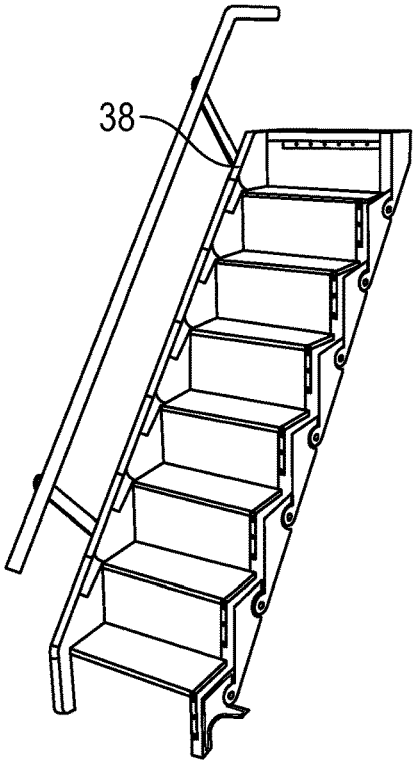

FIGS. 12*a* and 12*b* show a modular moving side foot 36. This is the foot section of the movable side stringer 12. It provides contact with the ground when the stairs are in the open/extended position. FIG. 13*a* shows a side module 37 of the movable side stringer 12 of the staircase. A plurality of the side modules 37 forms the movable side stringer 12 as seen in FIG. 13*b*. The number of side modules 37 needed depends on the number of modular main support pieces 32 on the fixed side stringer 14, and the desired height/length of the staircase. The side foot 36 connection to the side module 37 above, as well as the connection between each of the side modules 37, allows for a fixed assembly by means of a toothed section of each module (not seen in the accompanying Figures) and a corresponding receptive part for the toothed section in each side module 37. The foot and top modules 30, 34 as well as the side modules 32 of the fixed side stringer 14 have similar toothed connection means. There may be several different variations of the toothed section to enable different angles for the staircase. FIGS. 14*a* and 14*b* show a modular moving side top piece 38. The top piece 38 is the top section of the moving side 12 of the staircase. The top piece 38 makes contact with the top step or the platform that is fixed to the static floor above. It also connects with one of the arms 18 of the handrail 16.

Figure 15A:
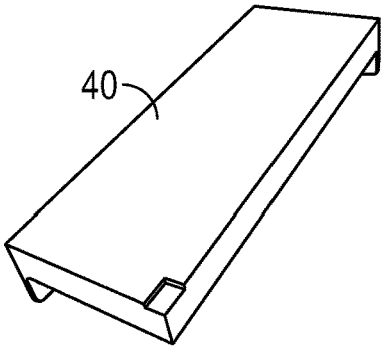
FIGS. 15*a* and 15*b* show top step or platform of the stairs.
Figure 15B:
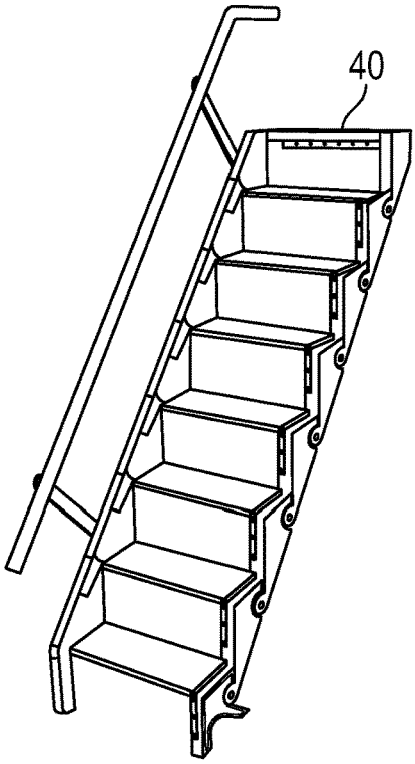
Figure 16A:
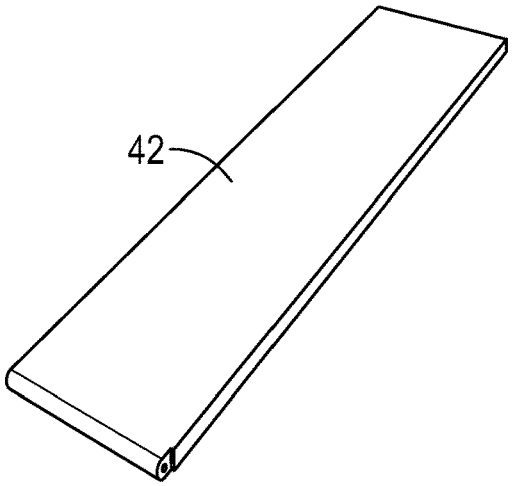
FIGS. 16*a* and 16*b* show a basic step of the modular staircase.
Figure 16B:
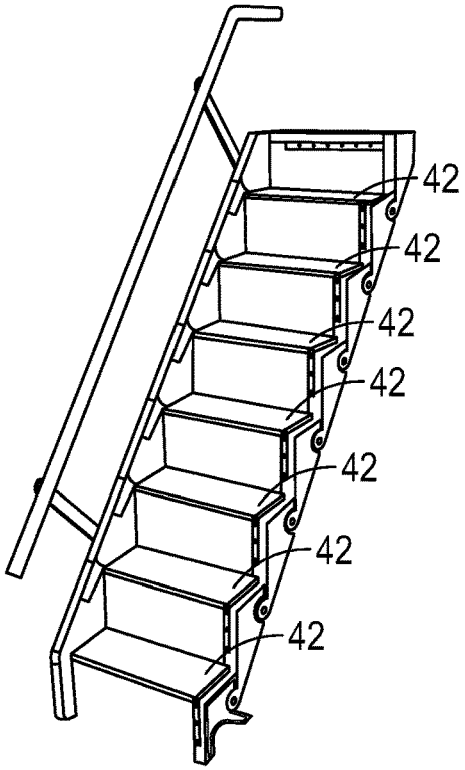

The top step 40, seen in FIGS. 15*a* and 15*b*, is connected to the top support module 34 of the fixed side stringer 14. When the staircase is assembled and installed, the top step will be fixedly attached to the floor above and the top support module 34 of the fixed side stringer is connected to the side wall. A plurality of basic steps 42 is shown in FIGS. 16*a* and 16*b*. The basic steps 42 make up the platform for stepping up and down the staircase. There is one basic step 42 for each side module 37 and 32 of the movable side stringer 12 and the fixed side stringer 14. The basic steps 42 also act as a parallel wishbone system such as found on car suspension so that when the movable side stringer 12 is shifted it always remains parallel to the fixed side stringer 14. When assembled and installed, the fixed side stringer 14 is attached to a side wall of a room, typically in at least two or more points along the fixed side 14.

Figure 17A:
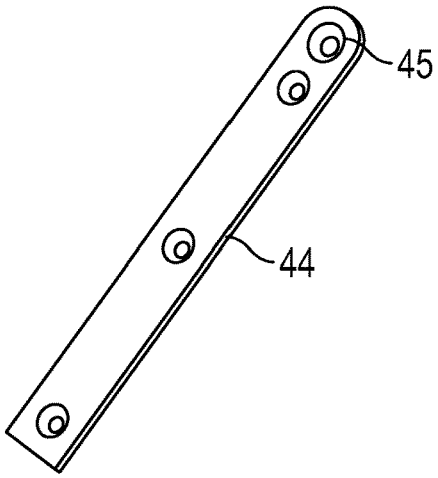
FIGS. 17*a* and 17*b* show a hinge plate.
Figure 17B:
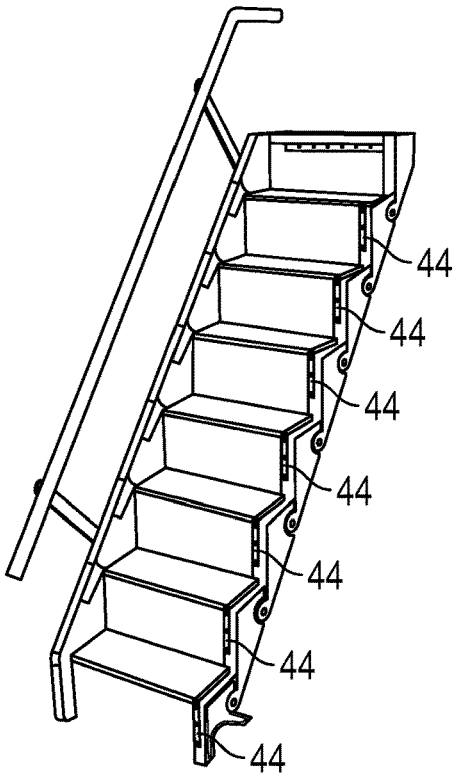
Figure 18A:
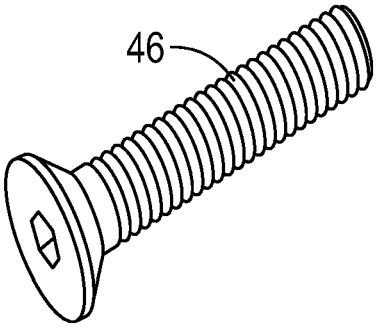
FIGS. 18*a* and 18*b* show a screw attaching a hinge plate to a modular piece.
Figure 18B:
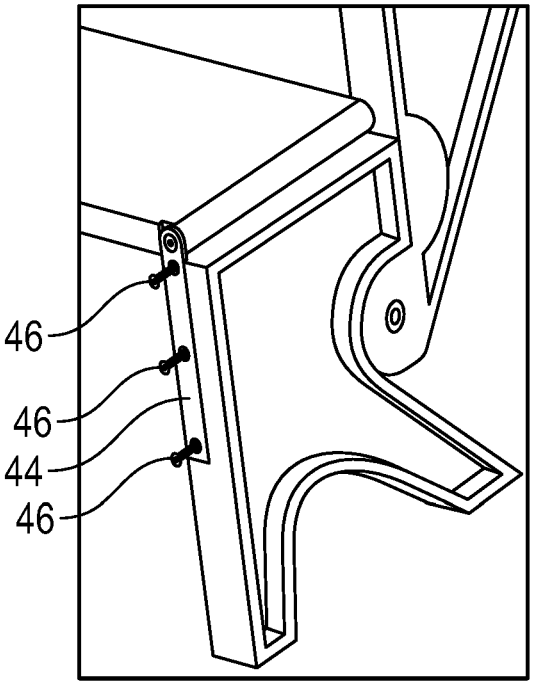
Figure 19A:
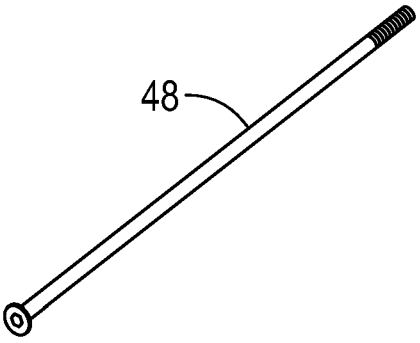
FIGS. 19*a* and 19*b* show a long screw that acts as a hinge at the pivot point of each step.
Figure 19B:
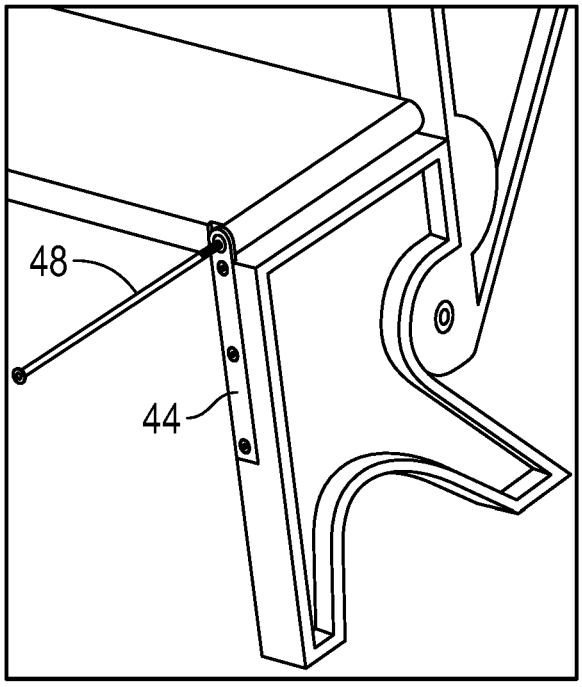

FIGS. 17*a* and 17*b* show a plurality of hinge plates 44. The hinge plate 44 is a stainless steel piece of metal that attaches to each modular section 32 of the fixed side stringer, by means of three small self-tapping screws 46 (shown in FIGS. 18*a* and 18*b*). The fourth and larger hole 45 on the hinge plates 44 is reserved fora much longer screw 48 (shown in FIGS. 19*a* and 19*b*) that travels right through the step and into the next modular piece 32, providing a pivoting hinge for the steps. These screws 48 are long screws that attach through the hinge plate 44, then through step 42 and into the next modular part 32, 37 on the sides of the staircase structure. One of these screws 48 is attached to each end of each step, creating a hinging point on either side of step 42. The hinge plate 44 and screws 46, 48 are not visible for the movable side stringer but they attach each step 42 to the lower and back parts of the moving side modules 36, 37 and 38. Each screw 48 must be of suitable strength to be durable under the weight placed on the step as well as to accommodate frequent pivoting of the steps as the staircase extended and retracted. Alternatively, (as shown in FIGS. 20 and 21) the steps 42 may be connected to the stringers by keyway joints in the steps and modular sections 32 and 37. These keyway joints interlock together with the pivot screw 48.

Figure 21A:
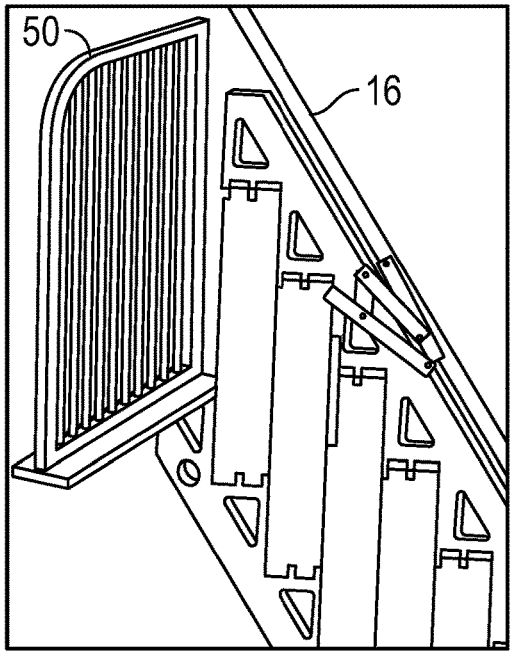
FIGS. 21*a* to *c* show the gate and its opening mechanism.
Figure 21B:
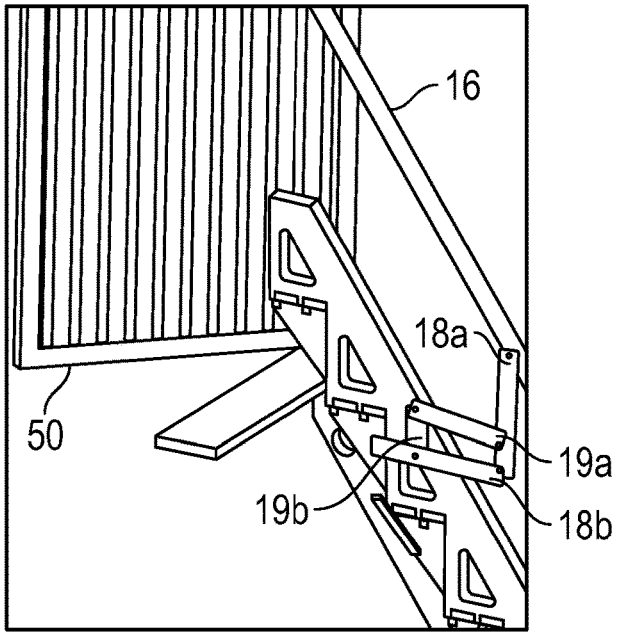
Figure 21C:
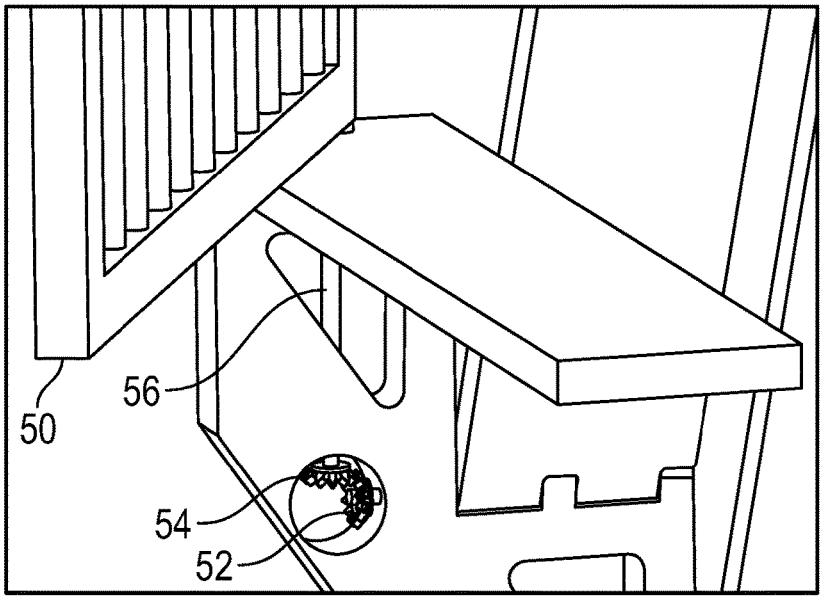

In an embodiment of FIGS. 21*a* to 21*c*, the staircase includes a gate 50 as a safety feature. The gate 50 prohibits access of any user when the stairs are folded flat to the wall and closes the gaping hole towards the lower level below. FIG. 21*a* shows a perspective view of the gate 50 being in its closed position when the staircase is in its retracted position i.e. folded flat against the side wall. FIG. 21*b* shows the gate 50 opening as the staircase is being extended. The gate and the staircase are interconnected so that when the gate is opened or closed from the top of the stairs by pushing or pulling the gate itself its movement actuates the extending or retracting movement of the staircase. Similarly, the gate opens and closes automatically and simultaneously when the stairs are extended or retracted on the lower level. This is achieved by a bevel gear mechanism 52, 54 and a pivotal rod 56. The gate is connected to the highest pivoting (basic) step 42 by the gear mechanism 52, 54 and the pivotal rod 56. More specifically, the gate is rotably attached to the fixed step 40 by the pivotal rod 56 that extends through the fixed step 40. The bevel gear mechanism 52, 54 and a second rotating driver rod connects the pivotal rod 56 and therefore, the gate, to the highest folding step 42 at its pivot point to the fixed side stringer 14. As the gate is pushed or pulled, the pivotal rod 56 rotates and drives the gears 52 and 54 that actuate pivoting of the highest folding (basic) step 42. Similarly, if the movable side stringer 12 or the handrail 16 is moved to extend or retract the staircase on the level below, each basic step 42 pivots and the pivoting movement of the highest basic step 42 rotates the gears 52 and 54 which in turn rotate the pivoting rod 56 connected to the gate. If the stairs are open and useable the gate is open and if the stairs are folded away and not useable the gate is closed, making the staircase always safe.

As described above, the gate 50, the stringers 12, 14 and the pivoting steps 42 together, and the handrail 16 together with its lever mechanism are interconnected so that whenever one of them is moved the other two move simultaneously.

This modular staircase and its modular parts allow the user to customize the height of the staircase by using only a screwdriver. The user needs to buy only the desired number of steps, thus enabling him to only pay for what is needed.

The staircase according to this invention can be used indoors and outdoors and provides maximum living space. It is ideal for use in small or confined areas such as an attic, courtyard or a boat. The staircase is inexpensive to construct, manufacture and transport. It can also be sold in modules so that users of the product can buy the staircase in modules and then construct the staircase themselves. The staircase has certain functions of a ladder, such as the compact size and the ability to be folded away, but also has the security, safety and robustness of a fixed staircase in a cost effective all in one structure.

This product is a compact and space efficient unit which makes the best use of the limited space, while still maintaining the ability to ascend and descend as required. The goal of the modular staircase is to provide a compact, simple to use and efficient staircase that takes up as little space as possible. It is stable and durable, has a good load capacity, and looks aesthetically pleasing. In addition, it is safe to use and has a high level of security. It is easy to transport from purchase to installation location as it is relatively light, and flat packable. Furthermore, it is easy to construct and install.

The modular parts are preferably manufactured by injection molding but can be manufactured by any other suitable manufacturing method. Material used for the parts can be any suitable long-lasting material such as aluminium alloy, aluminium casting alloy, metal, nonferrous metal, stainless steel, annealed or the like. The solid sided versions are all made from Bamboo plyboard. The steps can be made of a similar material to the moving parts, remanufactured bamboo or wood such as pine wood and/or other natural materials. Also the modular pieces can be made from remanufactured bamboo, wood, ply or alloys.

The staircase is also designed to be aesthetically attractive. The hand rail is cylindrical in design and of a size that is common to fit the 95 percentile group that would be recommended to use this device. The weight of the staircase is measured at instillation and counterbalanced with a suitable coil spring to enable to user to operate movement of stairs with no more pressure than can be applied with two fingers. Preferably, one or more coil springs are attached to the fixed side stringer and either the moving side stringer 12 or a pivoting step 42 via a cable and pulley mechanism so that the action of opening the stair pulls the coil spring taught and thus relieves weight of the moving stringer and the steps to make the stairs very lightweight to move. The height of the hand rail is applicable to 75-85% percent of men and women that would use this device. All parts involved on the staircase structure are CNC routed, cast and molded with a minimum 5% radius on all edges to ensure no sharp or dangerous parts are left protruding. At no time does the user have to reach higher than shoulder height to operate stairs. The aforementioned percentages are calculated based on an average height of adult men (178.4 cm) and woman (163.9 cm) in Australia today.

Reference throughout this specification to 'one embodiment_, 'some embodiments_ or or 'an embodiment_ means that a particular feature, structure or characteristic described in connection with the embodiment is included in at least one embodiment of the present invention. Thus, appearances of the phrases 'in one embodiment_, 'in some embodiments_ or 'in an embodiment_ in various places throughout this specification are not necessarily all referring to the same embodiment, but may. Furthermore, the particular features, structures or characteristics may be combined in any suitable manner, as would be apparent to one of ordinarily skill in the art from this disclosure, in one or more embodiments.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter.

It should be appreciated that in the above description of exemplary embodiments of the invention, various features of the invention are sometimes grouped together in a single embodiment, Figure, or description thereof for the purpose of streamlining the disclosure and aiding in the understanding of one or more of the various inventive aspects. This method of disclosure, however, is not to be interpreted as an intention that the claimed invention requires more features than are specifically recited in each claim. Rather, as the following claims reflect, inventive aspects lie in less that all features of a single foregoing disclosed embodiment. Thus the claims following the Detailed Description are hereby expressly incorporated into this Detailed Description, with each claim standing on its own as a separate embodiment of this invention.

Furthermore, while some embodiments described herein include some but not other features included in other embodiments, combination of features of different embodiments are meant to be within the scope of the invention and form different embodiments, as would be understood by those skilled in the art. For example, in the following claims, any of the claimed embodiments can be used in any combination.

In the description provided herein, numerous specific details are described. However, it should be understood that embodiments of the invention may be practiced without these specific details. In addition, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention. The present embodiments are, therefore, to be considered in all respects as illustrative and not restrictive.

The invention claimed is:

1. A retractable staircase comprising:

a first side stringer and a second, substantially parallel, side stringer connected by a plurality of steps, the first side stringer being fixedly attachable to a wall and the second side stringer being pivotally movable about the first side stringer between an extended position, where the steps lie substantially horizontally between the stringers, and a retracted position where the steps lie substantially vertically between the stringers, wherein each side stringer comprises a plurality of discrete modular sections, wherein the modular sections are detachably connected to one another such that a height and length of each side stringer is configured to be varied to enable selecting a desired length of the staircase.

2. The retractable staircase according to claim 1, wherein each modular section includes a toothed male connector and a female receiving part.

3. The retractable staircase according to claim 1, wherein each step is rectangular and pivotally connected to the first, fixed side stringer at one short end and to the second, movable side stringer at the other short end.

4. The retractable staircase according to claim 1, wherein the retractable staircase comprises one basic step for each modular section of the second side stringer and the first side stringer, and wherein each of the basic steps act as a parallel wishbone system so that when the second side stringer is shifted the second side stringer always remains parallel to the first side stringer.

5. The retractable staircase according to claim 1, wherein in the retracted position, the second side stringer lies flat against the wall, separated from the first side stringer by a length of each step.

6. The retractable staircase according to claim 1, wherein a screw is attached to each end of each step creating a hinging point on either side of the step.

7. The retractable staircase according to claim 1, wherein the steps are connected to the stringers by keyway joints in the steps and the modular sections, wherein the keyway joints interlock together with a pivot screw.

8. The retractable staircase according to claim 1, wherein the steps and the modular sections are made from remanufactured bamboo, wood, ply or alloys.

9. The retractable staircase according to claim 1, wherein the staircase is provided as a plurality of modules configured to be assembled together to form the selected, desired length of the staircase.

10. The retractable staircase according to claim 1, wherein the staircase further includes a gate.

11. The retractable staircase according to claim 10, wherein the gate is interconnected with the staircase and adapted to open or close substantially simultaneously with the staircase being extended or retracted respectively.

12. The retractable staircase according to claim 10, wherein extending or retracting of the staircase actuates opening or closing of the gate, and opening or closing of the gate actuates the staircase to be extended or retracted respectively.

13. The retractable staircase according to claim 10, wherein the gate is connected to the highest pivoting step by a gear mechanism and a pivoting rod.

14. The retractable staircase according to claim 1, wherein each side stringer further comprises a top section and a foot section with the plurality of modular sections located therebetween.

15. The retractable staircase according to claim 14, wherein the foot section of the first side stringer provides contact with a ground surface and supports a remainder of the first side stringer.

16. The retractable staircase according to claim 14, wherein the top section of the first side stringer provides contact with the wall and top step or platform.

17. The retractable staircase according to claim 14, wherein the foot section of the second side stringer provides contact with a ground surface when the staircase is in the extended position.

18. The retractable staircase according to claim 14, wherein the top section of the second side stringer makes contact with a top step or platform fixed to a static floor above.

19. The retractable staircase according to claim 1, wherein the staircase further includes a handrail attached to the second, movable side stringer by two or more elongate rail arms.

20. The retractable staircase according to claim 19, wherein each rail arm comprises two elongate members pivotally connected to one another at one end and to an associated side stringer at the other end.

21. The retractable staircase according to claim 19, wherein the rail arm is supported by a locking arm mechanism.

22. The retractable staircase according to claim 19, wherein the handrail is interconnected with at least one of: the second side stringer and the pivoting steps; and adapted to extend or collapse substantially simultaneously with the staircase being extended or retracted respectively.

23. The retractable staircase according to claim 19, wherein extending or retracting of the staircase actuates the handrail to be extended or collapsed respectively, and extending or collapsing of the handrail actuates the staircase to be extended or retracted respectively.

24. The retractable staircase according to claim 19, wherein a lever mechanism attaches each rail arm to one of the pivoting steps.

25. The retractable staircase according to claim 19, wherein the lever mechanism comprises at least one ball joint, a lever and a push rod.

26. The retractable staircase according to claim 19, wherein the staircase further includes a gate and wherein each one of the handrail, the side stringers together with the pivoting steps, and the gate are interconnected such that moving one moves the other two substantially simultaneously.

27. The retractable staircase according to claim 19, wherein the handrail is movable between an extended position where the rail arms are upright and the handrail is substantially parallel to the movable side stringer, and a collapsed position, where the handrail lies adjacent the movable side stringer.

28. The retractable staircase according to claim 27, wherein each rail arm is pivotally connected to the movable side stringer via a fixing plate having two releasable locking positions: the upright rail arm position and the collapsed handrail position.

29. A retractable staircase comprising:

a first side stringer and a second, substantially parallel, side stringer connected by a plurality of pivoting steps, the first side stringer being fixedly attachable to a wall and the second side stringer being pivotally movable about the first side stringer between an extended position, where the steps lie substantially horizontally between the stringers, and a retracted position where the steps lie substantially vertically between the stringers;

a telescoping handrail attached to the second, movable side stringer by two or more rail arms, the handrail being interconnected with at least one of: the second side stringer and the pivoting steps, and configured to extend or collapse in a telescopic manner substantially simultaneously with the staircase being extended or retracted respectively; and a gate, wherein the gate is interconnected with the staircase and configured to open or close substantially simultaneously with the staircase being extended or retracted respectively.

* * * * *